United States Patent [19]

Graham et al.

[11] 4,363,087

[45] Dec. 7, 1982

[54] MOUNTING POST FOR HOLDING A LIGHTED ELECTRICAL PUSHBUTTON SWITCH

[75] Inventors: Bruce L. Graham, Wheeling; Iran R. Littman, Wheaton, both of Ill.

[73] Assignee: Illinois Tool Works Inc., Chicago, Ill.

[21] Appl. No.: 227,283

[22] Filed: Jan. 22, 1981

[51] Int. Cl.[3] ..... F21V 17/00

[52] U.S. Cl. ..... 362/382; 362/295; 362/311; 362/353; 362/355; 362/375; 362/448; 362/455; 362/800

[58] Field of Search ..... 362/382, 295, 311, 353, 362/355, 375, 448, 455, 800

[56] References Cited

U.S. PATENT DOCUMENTS 3,883,734 5/1975 Joiner et al. ..... 362/448

4,195,330 3/1980 Savage ..... 362/455

*Primary Examiner*—Stephen J. Lechert, Jr.

*Attorney, Agent, or Firm*—Thomas W. Buckman

[57] ABSTRACT

A mounting post for holding a light emitting diode in an electrical pushbutton switch is formed by a cylindrical base which has a pair of cut-out sections located intermediate the top and bottom surfaces of the base which are diametrically opposed on opposite sides of the base. The cut-out sections divide a pair of elongated, parallel passageways for the leads of a light emitting diode (LED) or other light device into upper and lower segments so that a portion of the leads of the inserted LED are exposed in the cut-out sections. The leads of the LED are then crimped in the cut-out sections so that the lead forced against a rear wall of these sections with the leads being restrained from moving by engagement of the leads with upper and lower walls of the cut-out sections.

1 Claim, 2 Drawing Figures

MOUNTING POST FOR HOLDING A LIGHTED ELECTRICAL PUSHBUTTON SWITCH

BACKGROUND OF THE INVENTION

A mounting post for supporting a light emitting diode (LED) or other lighting device in a lighted electrical pushbutton switch makes the handling of the LED much more convenient, when it is desired to insert or remove the LED from the switch. These posts are conventionally constructed with a generally cylindrical base having a pair of parallel passageways that run all the way through them from their top to their bottom surfaces for receiving the leads of the LED. In the past, in order to secure the LED to such a post, several different methods were employed; but none of these proved to be entirely satisfactory.

For example, the leads were twisted after they emerged from the bottom of the post; but this was an awkward procedure; and at times it was difficult to keep the terminal ends of the leads in parallel position for insertion into printed circuit boards. Another method of securing the leads was to glue them in; however, this procedure required additional equipment and materials and required curing time for the adhesive. A third method for securing the leads in the support post was merely to employ friction. However, this method had the disadvantage of requiring tighter tolerances in order to insure that the leads would not fall out of the post too easily due merely to gravitational force.

the present invention provides a mounting post for an LED, or other lighting device, which securely holds the LED on the mounting post in a manner which requires no adhesive, and which does not require the closer tolerances needed to obtain friction holding and which insures that the lead will be substantially parallel after they emerge from the passageways of the post.

DESCRIPTION OF THE DRAWINGS

The present invention is described by reference to the drawings in which.

TECHNICAL DESCRIPTION OF THE INVENTION

Figure 1:
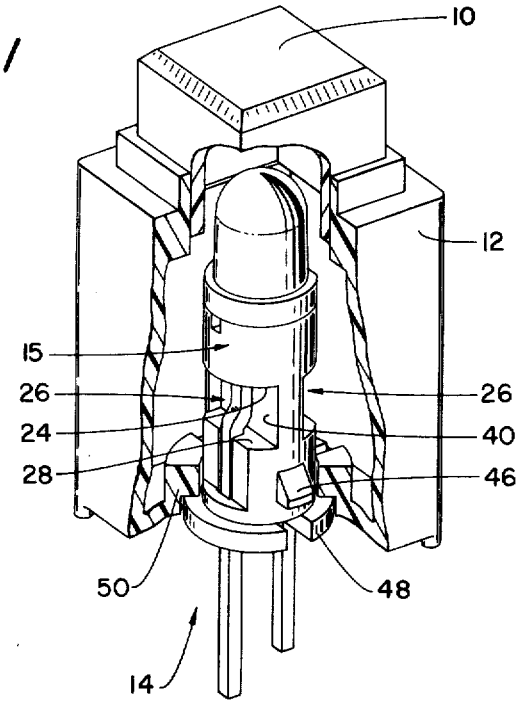
FIG. 1 is a perspective, partially broken-away view that shows the lighted pushbutton cap, a portion of the housing of the lighted pushbutton switch, an LED and the LED support post of the present invention.
Figure 2:
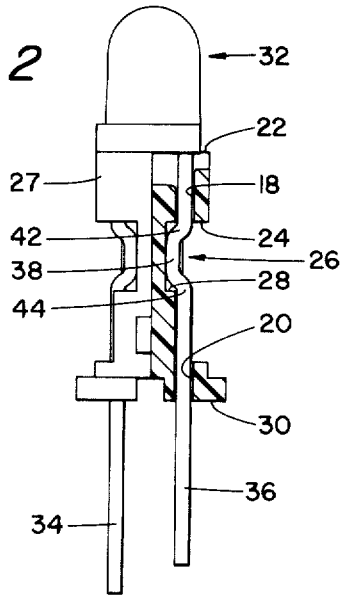
FIG. 2 is a partial cross-sectional view in which a portion of the post of FIG. 1 is cross-sectioned to show how the leads of the LED are secured in the support post according to the present invention.

An electrical pushbutton switch is shown in FIG. 1 in which a pushbutton cap 10 rests for movement in the housing 12. The remainder of the actuating mechanism of the pushbutton switch is not shown since the present invention may be utilized with any electrical pushbutton switch in which a light emitting diode and its mounting post are retained so that light projects from the LED or other light source, through the transparent or translucent pushbutton cap 10. A light emitting diode mounting post 14, constructed in accordance with the present invention, is shown which has a cylindrical base 15 and a pair of parallel, lead receiving passageways, one for each of the leads of the LED, each of which are split into two segments, an upper segment 18 and a lower segment 20 by the cut-out sections 26 diametrically opposed on opposite sides of the base 15.

The upper segment of the passageway 18 extends from the top surface 22 of the base to the lower surface 24 of a section 26. The lower segment 20 extends from bottom surface 28 of a section 26 to the bottom surface 30 of the post 14. A LED 32 is inserted into a mounting post so that its leads 34, 36 extend through the passageways, thus leaving intermediate portions 38 of the leads exposed in the cut-out sections 26. These intermediate portions 38 may be crimped by a pliers, or other suitable tool, into the sections 26 so they engage the rear walls 40 of the sections 26 which are recessed from the outer periphery 27 of the base 15. This serves to lock the leads 34, 36 between the upper wall 18 and the lower wall 28 of each of the sections 26 due to the bends 42, 44 that are correspondingly formed in the leads. In this manner, the LED is securely locked into place in the mounting post.

The mounting post may then be locked into the housing of the switch by the locking blocks 46, 48 which, respectively, engage the upper and the lower surfaces of the locking ring 50 that is formed on the housing 12. The LED may thus be locked into placed and supported on the mounting post in a manner which keeps the leads parallel after they emerge from the bottom surface of the mounting post without requiring adhesive or a friction fitting and without the necessity of twisting the leads.

What is claimed is:

1. In a mounting post having a generally cylindrical base for supporting a light source for an electrical lighted pushbutton switch that has a pair of leads, wherein the leads of the light source pass through parallel passageways that run through said base from the top surface to the bottom surface of said base, the improvement comprising a pair of diametrically opposed cut-out sections, each of which receive one of said leads so as to expose a portion of said received lead in said section, said sections being located intermediate the ends of said base and comprising a rear wall which is recessed from the outer periphery of said base and upper and lower walls which thereby divide said passageways into upper and lower segments on opposite sides of said cut-out sections and allowing said exposed portions of each of said leads to be inwardly crimped towards said rear wall of its respective cut-out sections so that said leads are securely locked into place in a said cut-out section between said upper and lower walls.

* * * * *